US009149164B2

(12) United States Patent
Giustetto

(10) Patent No.: US 9,149,164 B2
(45) Date of Patent: Oct. 6, 2015

(54) WINDOW CLEANING EQUIPMENT

(75) Inventor: Loris Eugenio Lazzareno Giustetto, Brescia (IT)

(73) Assignee: PULEX S.R.L., Brescia (IT)

( * ) Notice: Subject to any disclaimer, the term of this patent is extended or adjusted under 35 U.S.C. 154(b) by 107 days.

(21) Appl. No.: 13/988,384

(22) PCT Filed: Sep. 3, 2012

(86) PCT No.: PCT/EP2012/003683

§ 371 (c)(1),
(2), (4) Date: May 20, 2013

(87) PCT Pub. No.: WO2013/034272

PCT Pub. Date: Mar. 14, 2013

(65) Prior Publication Data

US 2013/0239345 A1 Sep. 19, 2013

(30) Foreign Application Priority Data

Sep. 8, 2011 (IT) ..... MI2011A1625

(51) Int. Cl.

| | |
|---|---|
| ***B05B 15/00*** | (2006.01) |
| ***A47L 1/08*** | (2006.01) |
| ***B05B 1/30*** | (2006.01) |
| ***B05B 9/08*** | (2006.01) |
| *B05B 15/06* | (2006.01) |

(52) U.S. Cl.

CPC ..... *A47L 1/08* (2013.01); *B05B 1/3013* (2013.01); *B05B 9/0838* (2013.01); *B05B 15/005* (2013.01); *B05B 15/006* (2013.01); *B05B 15/06* (2013.01)

(58) Field of Classification Search

CPC ..... A47L 1/08; B05B 15/006; B05B 11/0054
USPC ..... 401/138, 276
See application file for complete search history.

(56) References Cited

U.S. PATENT DOCUMENTS

| | | | | |
|---|---|---|---|---|
| 5,364,198 | A * | 11/1994 | Skenderi | 401/138 |
| 6,779,693 | B2 * | 8/2004 | Sweeton et al. | 222/464.4 |
| 2005/0191116 | A1 * | 9/2005 | Flanery et al. | 401/272 |
| 2012/0067038 | A1 * | 3/2012 | Becocci | 60/458 |

OTHER PUBLICATIONS

International Preliminary Report on Patentability (IPRP) for priority application PCT/EP2012/003683, mailed Mar. 20, 2014 (7 pages).

* cited by examiner

*Primary Examiner* — David Walczak
*Assistant Examiner* — Joshua Wiljanen
(74) *Attorney, Agent, or Firm* — Abelman, Frayne & Schwab

(57) ABSTRACT

A window cleaning implement (10) comprises a tubular body divided into rear (12) and front (14) segments inserted telescopically one inside the other and connected by a threaded ring nut (16); the front segment supports a cleaning head (24) fitted with hooking devices for a cloth in microfiber or other suitable material. Said implement comprises, in addition, a removable reservoir (20) for the washing liquid which is drawn from it by means of a manual pump incorporated in said implement, channelled along a flexible hose (32) and dispensed through at least one nozzle (30) placed next to said cleaning head (24).

6 Claims, 6 Drawing Sheets

20
70
68
69
56
54
60
67

WINDOW CLEANING EQUIPMENT

CLAIM FOR PRIORITY

This application claims priority to PCT/EP2012/003683, filed 3 Sep. 2012, which claims benefit to Italian Application No. MI2011A001625, filed on 8 Sep. 2011.

FIELD OF THE INVENTION

The present invention relates to a window cleaning implement.

More specifically, the present invention relates to a manually operated implement, suitable for cleaning windows, especially indoors but also surfaces of other kinds such as tiled surfaces.

BACKGROUND OF THE INVENTION

It is known that for the periodic cleaning of windows, especially in offices and places open to the public such as railway stations and airports, gyms and restaurants, cleaning staff use specific implements which enable them to reach considerable heights from the ground without the use of ladders. Such implements, in their simplest form, typically comprise a pole which at the upper end bears a head supporting a strip of spongy material or microfibre extending horizontally used to distribute water and specific cleaning products on the surface to be cleaned. Said implement comprises, to the side of said strip, a squeegee in plastic material used to collect the liquid distributed on the surface, bringing it down to a height where it can be removed with a cloth.

Other implements of this type are fitted with a telescopic pole for height adjustment and a swivel head, to which a tube supplying the liquid contained in a drum, is connected.

The latter constitutes an element of obstruction, hindering and conditioning the operator, which must be systematically moved together with the implement, to the windows and surfaces to be cleaned in different places and environments. If the drum comes with a pump for distributing the liquid on the implement or on the windows, the drawbacks increase in that as well as the additional weight of the pump, an electricity supply is required; generally speaking the electricity is provided by batteries incorporated in a belt worn by the operator. This solution however further conditions the freedom of movement of the operator. Similar drawbacks arise in the case of a reservoir with pump arranged in the form of a backpack worn on the shoulders.

Machines are also known of for the external washing of large windows or surfaces consisting of solar panels. In this case however the machines are complex and expensive, comprising a transportable structure with a liquid reservoir and relative, electrically powered pump and are not suitable for cleaning windows internally or surfaces distributed over various rooms.

In U.S. Pat. No. 5,364,198 a window cleaning implement is described comprising an extendable tubular body, along which a tube extends fitted with a nozzle at the front end next to a squeegee; a reservoir bearing an actuating lever to dispense the fluid is attached to the rear end of the tubular body.

A similar appliance is described in U.S. Pat. Pub. No. 2004/146332 wherein the dispenser pump of the fluid is electrically operated by a battery placed in the grip. U.S. Pat. No. 5,657,909 relates rather to a manual sprayer of liquid detergent, wherein the actuating lever is used in conjunction with a piston interacting with a helical spring which sucks the liquid from the reservoir.

U.S. Pat. No. 5,195,664 describes a manual sprayer enabling withdrawal of the entire liquid content of the reservoir, regardless of the positioning thereof, thanks to a partly flexible hose with the free end paired to a weight.

All these known solutions however do not envisage the possibility of dispensing the washing liquid immediately and in a calibrated quantity, to avoid wastage.

SUMMARY OF THE INVENTION

The purpose of the present invention is to overcome the drawbacks complained of above.

More specifically, the purpose of the present invention is to provide a window cleaning implement comprising a detachable part destined to contain the washing liquid and incorporating a manually activated pump to transfer said liquid quickly and in a calibrated manner to the surface to be cleaned.

A further purpose of the invention is to provide an implement suitable for guaranteeing portability and easy movement thereof by the operator, entirely independent of external drums or electric pumps.

Not least, another purpose of the invention is to make a compact implement of limited weight, able to permit extended functioning autonomy in relation to the capacity of the reservoir and the calibrated withdrawal of the washing liquid from the same.

A further purpose of the invention is to make available to users a window cleaning implement suitable for ensuring a high level of resistance and reliability over time, in addition such as to be easy and economical to produce.

These and other purposes are achieved by the window cleaning implement of the present invention according to the main claim.

The construction and functional characteristics of the window cleaning implement of the present invention will be more clearly comprehensible from the detailed description below in which reference is made to the appended drawings which show a preferred and non-limiting embodiment.

DETAILED DESCRIPTION OF THE INVENTION

Figure 1:
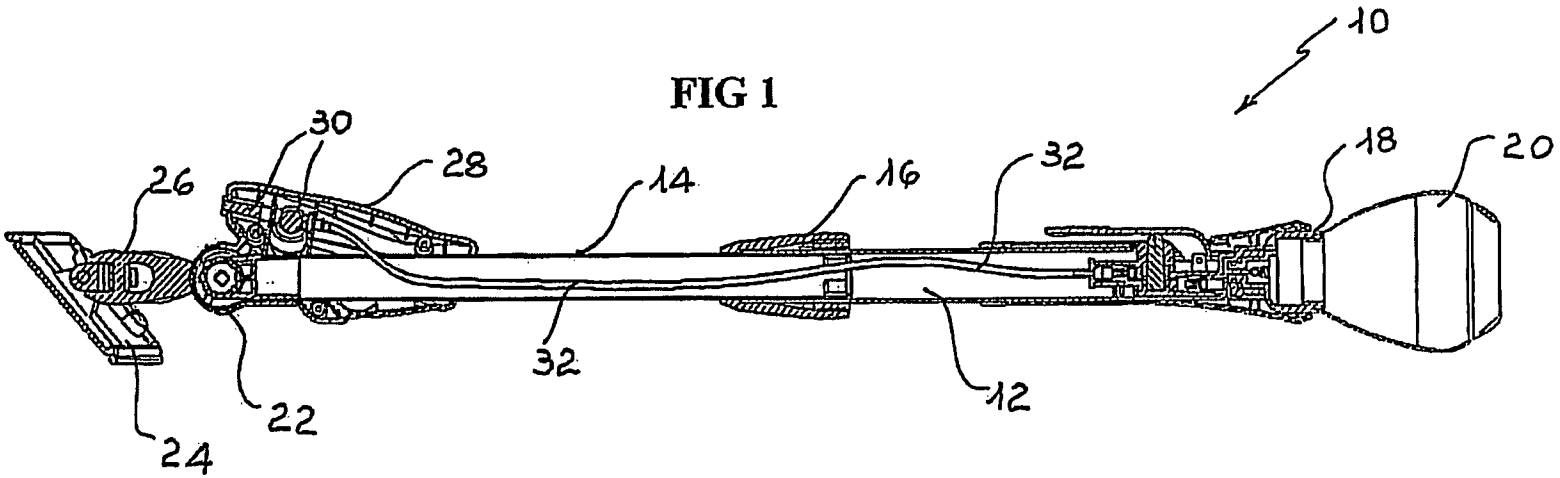
FIG. 1 schematically shows a longitudinal cross-section of the window cleaning implement of the present invention.
Figure 2:
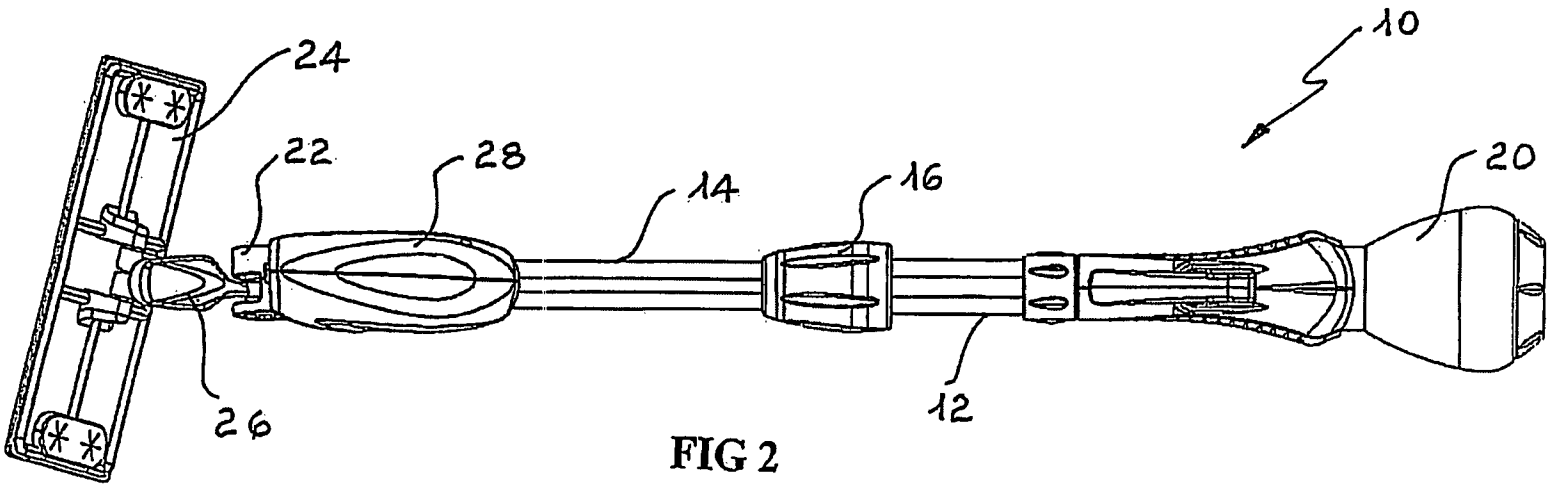
FIG. 2 schematically shows a view from above of the same implement.

With initial reference to FIGS. 1 and 2, the window cleaning implement according to the present invention, globally denoted by reference numeral 10, comprises a tubular body divided into a rear segment 12 and a front segment 14 inserted telescopically one inside the other and connected by a threaded ring nut 16. A container 20 of a tendentially ovoidal shape, constituting the reservoir which the washing liquid is placed in, generally water with specific detergents for the surface to be cleaned, is positioned at the rear end of the implement 10. The front segment 14 defines a fork attachment 22 for a rectangular shaped support 24 which constitutes the cleaning head and is fitted with known hooking devices (not shown) for a cleaning cloth in microfibre or other suitable material.

A connection element 26 of the known type is integrated between the fork attachment 22 and the support 24 which permits said support to be swivel jointed vertically and horizontally.

The fork attachment 22 projects from a shaped sleeve 28 which is fitted to the end of the front tubular segment; the latter incorporates the dispenser means of the washing liquid, consisting of at least one nozzle 30 which comes out of the shaped sleeve 28 in a position above the fork attachment 22. The nozzle 30 is supplied by a flexible tubular hose 32 which extends through the two tubular segments 12, 14.

Figure 4:
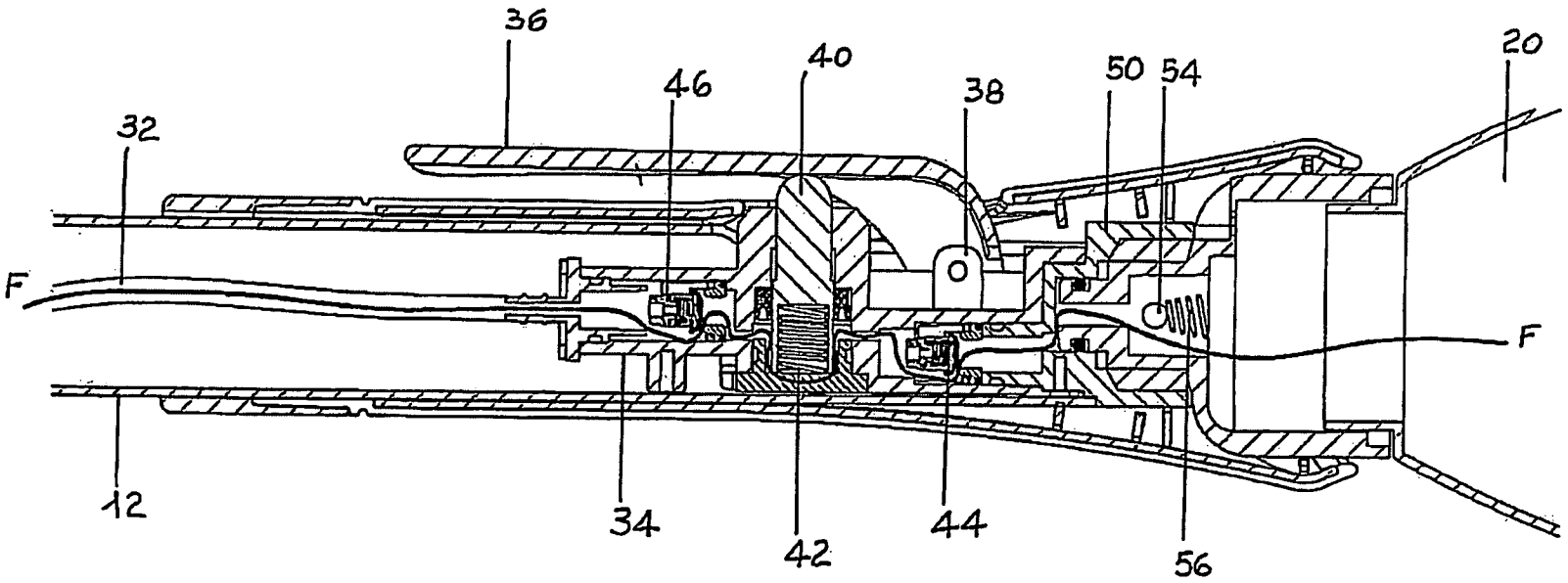
FIG. 4 schematically represents the same implement according to FIG. 3, to highlight the flow line of the liquid coming from the reservoir.
Figure 5:
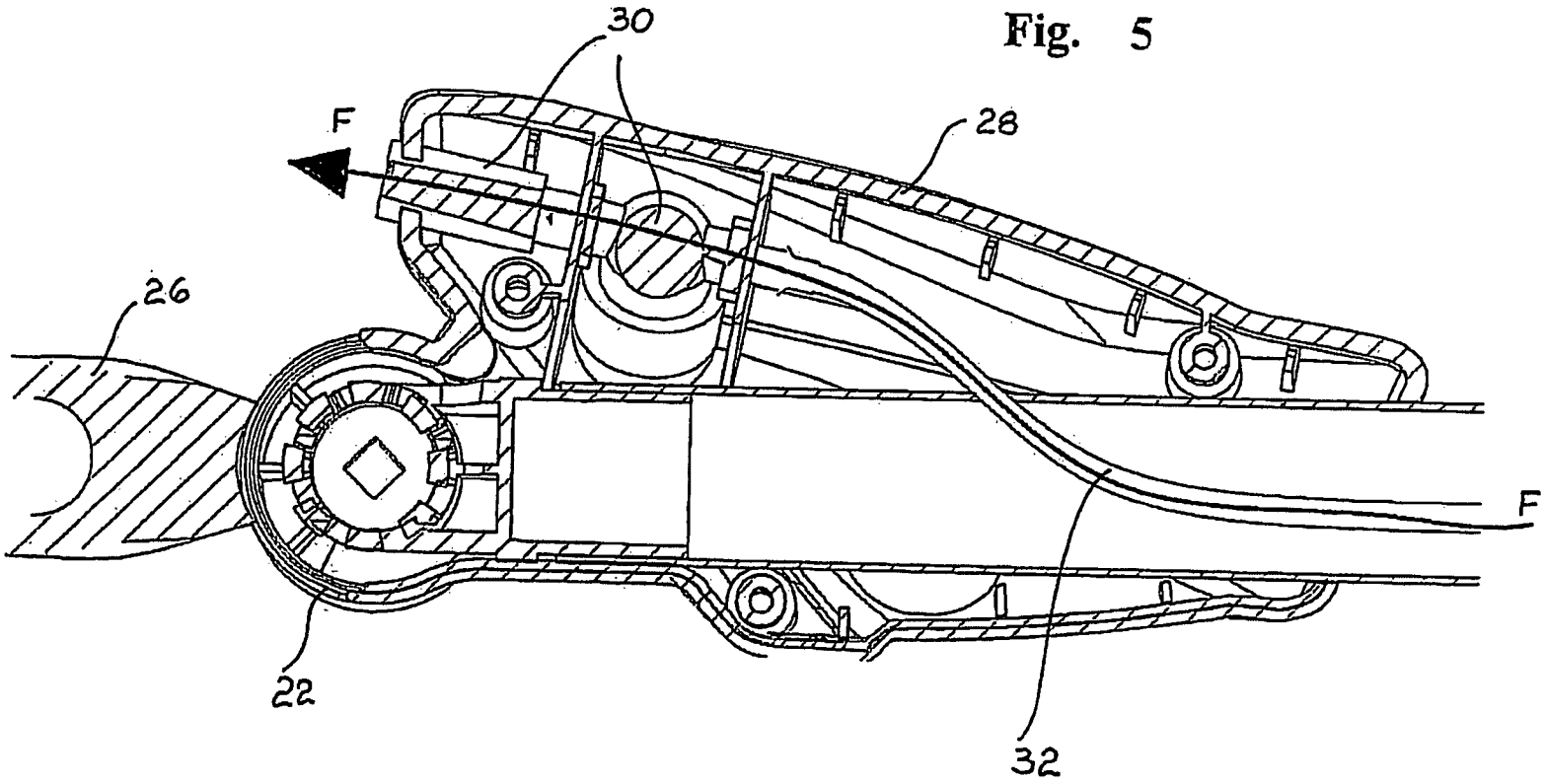
FIG. 5 schematically shows the longitudinal cross-section of the front part of the same implement, to highlight the flow line of the liquid coming out of a nozzle dispenser.
Figure 6:
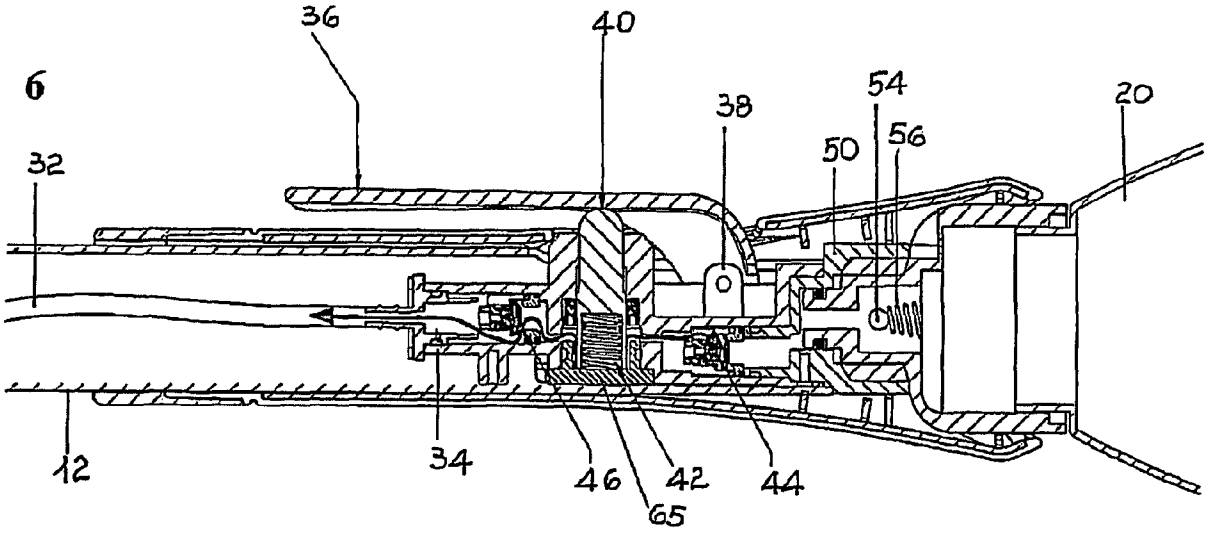
FIG. 6 schematically represents part of the implement to highlight the liquid dispensing step.
Figure 7:
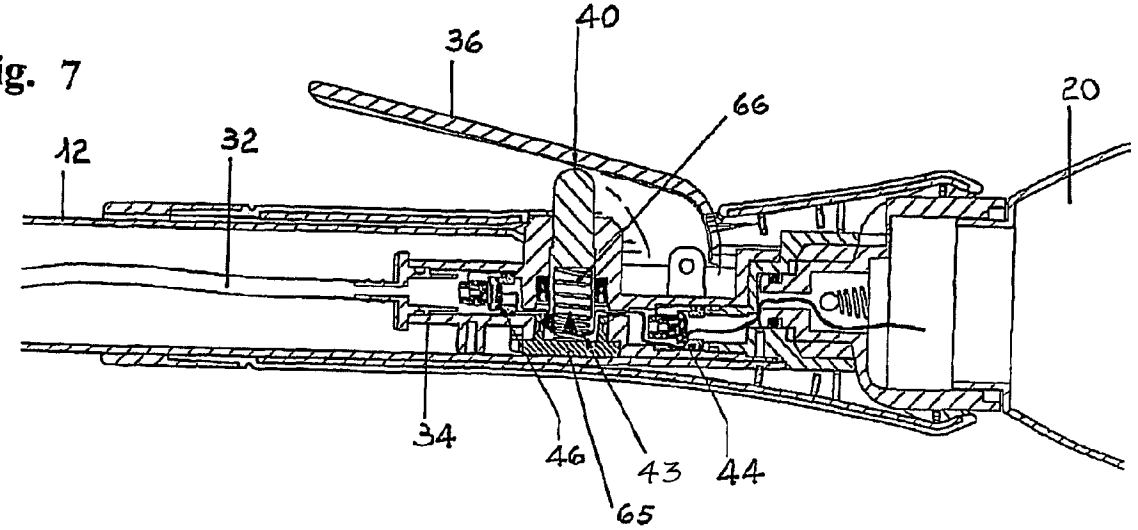
FIG. 7 schematically represents part of the implement to highlight the filling step, before the dispensing of liquid.

Said 30 nozzle connects via said flexible tubular hose 32 to a connector 34 coming out of a manually actuated pump which draws the washing liquid from the reservoir 20 and channels it into the tubular hose 32 by means of which it reaches the dispenser nozzle 30, according to the flow diagram "F" as in FIGS. 4 and 5. The manually actuated pump, advantageously of the self-priming kind, comprises a lever 36 pivoted on a support 38 placed in the tubular rear segment 12; said lever acts on a piston 40 which abuts with the underside of said lever, formed for example of a flattened element in plastic or metal. The piston 40 is placed under tension by a helical spring 42 abutting partially with a socket plug 65 and partially with an indentation 66 formed at the bottom of said piston and communicating with said socket plug 65. Two single direction shut-off valves 44 and 46 enable channelling of the flow of washing liquid from the reservoir 20 to the tubular hose 32, as specified below with reference to FIGS. 6 and 7.

Figure 3:
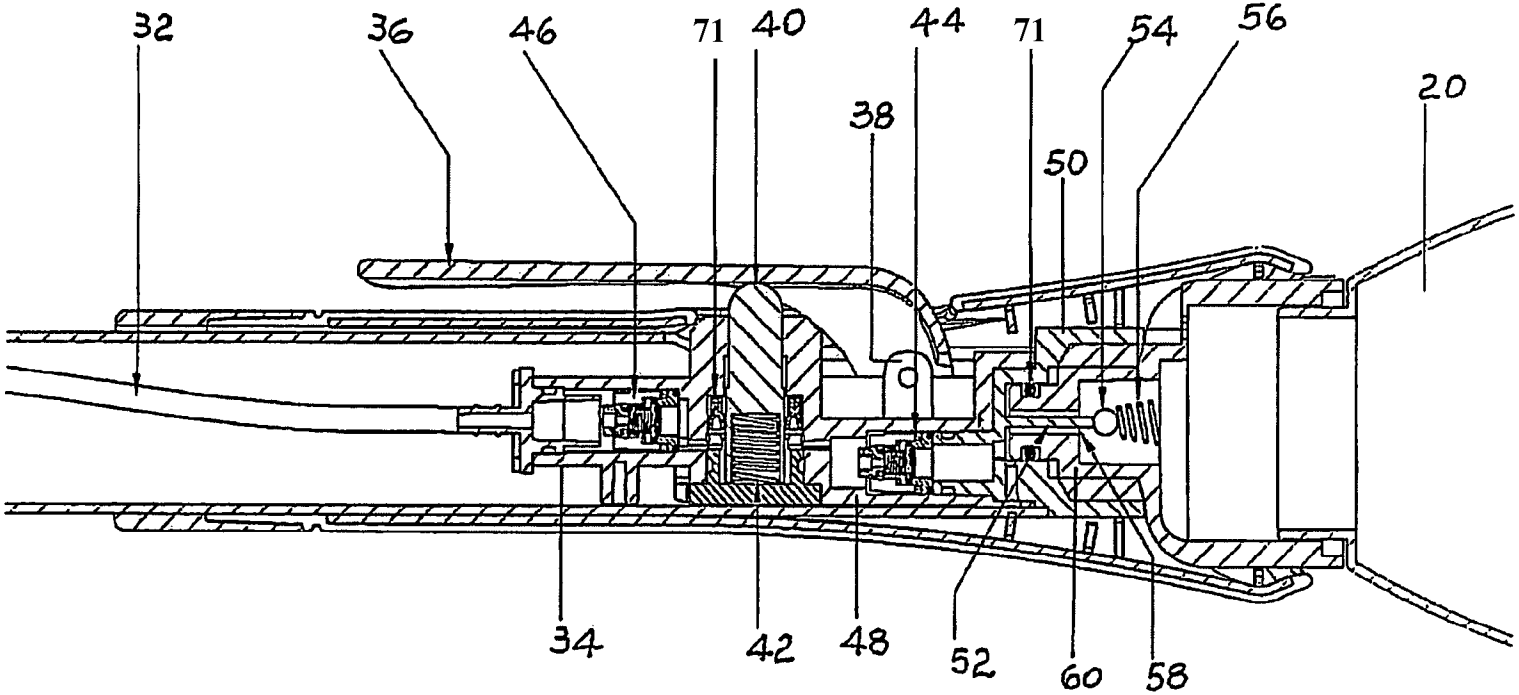
FIG. 3 schematically shows a partial longitudinal cross-section of the same implement in its rear part.

The valve 46, kept in position by the connector 34, and the valve 44 kept in position by the body indicated by reference numeral 50 (in FIG. 3) forming the seat of the reservoir plug 60, are positioned in the pump body 48 which has the function of containing all the components forming part of the implement, as schematised in said FIG. 3.

The pump body 48 is engaged on said body 50 and screwed thereto.

The body 50 extends rearwards, that is in the direction of the reservoir 20, in an integral pin 52, interacting with a ball 54 paired with a helical spring 56 (FIG. 3).

Said ball 54 has the function of closing the hole 58 of the plug 60 of the reservoir 20 at the moment in which the latter is removed for filling. The reservoir 20 is connected by threading to the plug 60 (FIG. 3), while the body 50 constitutes the element suitable for connecting the plug 60 and the reservoir 20 to the pump body 48 by threading.

Sealing gaskets 71 are positioned at the piston 40 and between the body 50 and the plug 60 of the reservoir 20.

During use, the user presses the lever 36 which in turn presses the piston 40. The latter, overcoming the resistance of the spring 42, presses the liquid inside the chamber created between the indentation 66 which forms part of the seat 43 of the piston 40 and the socket plug 65 which forms the other part of said seat 43 and is paired with the piston, as in FIG. 7. The liquid finds the valve 44 closed by effect of the relative spring and, given the pressure acting in the direction of closure of said valve, is obliged to direct itself towards the valve 46; the liquid overcomes the resistance of the spring of said valve 46 and therefore opens the circuit, thereby leaving said chamber 66 and channelling itself into the tubular hose 32. This first operating step is schematised in particular in FIG. 6. During the release step of the lever 36, the piston 40 pushed by the spring 42 creates negative pressure inside said chamber; the valve 46 is closed by effect of the respective spring. The air, by effect of the negative pressure which acts in the direction of closure of such valve, is forced to direct itself towards the valve 44, overcoming the resistance posed by the relative spring and opening the circuit towards the reservoir 20. Part of the liquid present in the reservoir spoken of may therefore reach the chamber 66 thereby filling the system for a subsequent pumping step. This second operating step is schematised in particular in FIG. 7.

The liquid dispensed by the nozzle 30 is distributed precisely on the glass or surface to be cleaned; the quantity of liquid to dispense is easily calibrated, without wastage or excess, thanks to the manual movement of the pump by means of single or repeated pressing of the lever 36.

Figures 8, 9, 10:
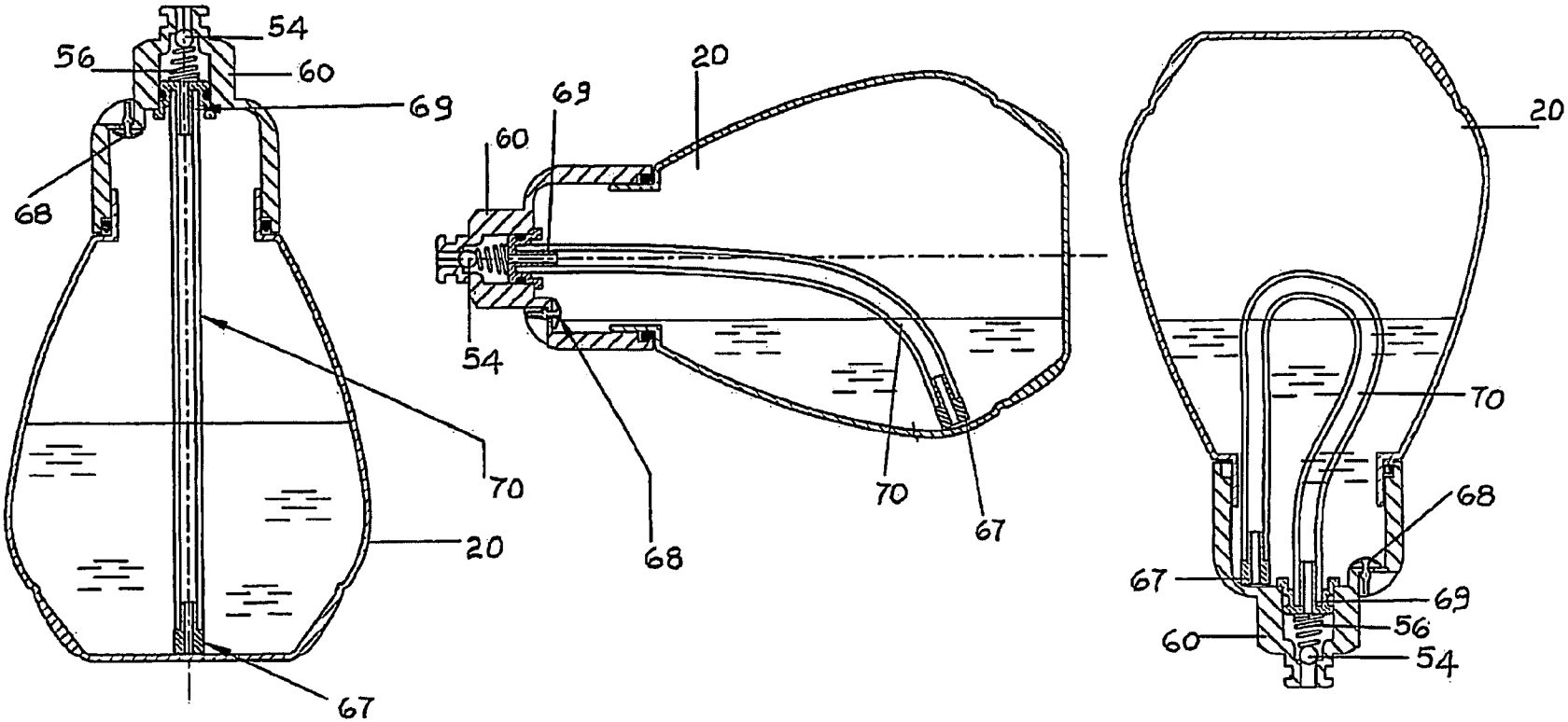
FIGS. 8, 9 and 10 schematically shows the same number of longitudinal cross-sections of the reservoir of the implement, to show the take up of the liquid in any working position.

The correct functioning of the implement 10 as regards dispensing the liquid in any working position is ensured by a lift pipe 67 and by a vent valve 68. The lift pipe 67 is positioned at the free end of a flexible tube 70, connected to the plug 60 by means of a liquid dispenser nipple 69; the vent valve 68 is positioned on the plug 60 itself, as may be observed in FIGS. 8, 9 and 10. The mobility of the flexible tube 70 and of the lift pipe 67 inside the reservoir 20 occurs automatically depending on the operating position assumed by the implement 10; the reservoir 20 may therefore find itself in a vertical position with the plug 60 facing upwards (FIG. 8), in a horizontal position (FIG. 9) or in an overturned position, that is with the plug 60 facing downwards (FIG. 10). In all these positions, as in all the intermediate positions of the reservoir 20, the flexible tube 70 suitably directs itself and the lift pipe 67 always finds the quantity of liquid, even residual, present in said reservoir. The lift pipe 67 is appropriately weighted to move the flexible tube 70.

The valve 68 has the function of stabilising the pressure inside the reservoir 20 compared to external pressure, so as to guarantee the self-priming of the pump and so as to avoid the possible implosion of said reservoir.

As may be seen from the above, the advantages which the invention achieves are evident. The window cleaning implement of the present invention makes it possible to operate easily and efficaciously, dispensing the washing liquid immediately and in calibrated quantities onto the surface to be cleaned. Such implement, in addition, ensures excellent portability, enabling the operator to perform cleaning operations without having to transport independent drums, and in any working position.

Despite the invention having been described above with particular reference to one of its embodiments, given solely by way of a non-limiting example, numerous modifications and variants will appear evident to a person skilled in the art in the light of the above description. The present invention therefore sets out to embrace all the modifications and variants which fall within the sphere and scope of the following claims.

The invention claimed is:

1. A window cleaning implement (10) comprises a tubular body divided into a rear segment (12) and a front segment (14) inserted telescopically one inside the other and connected by a threaded ring nut (16), wherein the front segment (14) supports a cleaning head (24) fitted with hooking devices for a cleaning cloth;

wherein the rear segment (12) includes a removable reservoir (20) for storing washing liquid which is drawn from it by means of a manual pump incorporated in the window cleaning implement (10) itself;

wherein the washing liquid is channelled along a flexible hose (32) connected to a connector (34) and dispensed through at least one nozzle (30) placed near said cleaning head (24), characterised in that said manually actuated pump is of the self-priming kind and comprises a lever (36) pivoted on a support (38) and acting on a piston (40) acting in conjunction with two single-direction valves (44, 46) respectively kept in position by the connector (34) and by a valve support body (50) forming a seat of a plug (60) of the reservoir (20);

wherein the reservoir (20) comprises a vent valve (68) as well as a flexible tube (70) connected at one end to the plug (60) by means of a liquid dispenser nipple (69); and wherein a weighted lift pipe (67) is provided at the free end of the flexible tube (70);

the window cleaning implement (10) characterised in that the piston (40) which the lever (36) acts on is placed under tension by a helical spring (42) placed partially in a socket plug (65); and the window cleaning implement (10) further characterised in that the lever (36) presses, by means of the piston (40), the washing liquid inside a chamber (66) created between the indentation of said piston which forms a seat (43) of the helical spring (42) and the socket plug (65).

2. The window cleaning implement (10) according to claim 1, characterised in that said single-direction valves (44, 46) are integrated in a pump-body (48) engaged on said valve support body (50) and screwed to it.

3. The window cleaning implement (10) according to claim 2, characterised in that said valve support body (50) extends in the direction of the reservoir (20) to form an integral pin (52), interacting with a ball (54) paired with a helical spring (56) to close the hole (58) of the plug (60) of the reservoir (20).

4. The window cleaning implement (10) according to claim 1, characterised in that the front end of the segment (14) of said tubular body forms a fork attachment (22) for a support constituting the cleaning head (24).

5. The window cleaning implement (10) according to claim 4, characterised in that a connection element (26) is positioned between the fork attachment (22) and the support, the connection element (26) forming a vertical and horizontal swivel joint of such support.

6. The window cleaning implement (10) according to claim 4, characterised in that said at least one nozzle (30) projects from a shaped sleeve (28) above the fork attachment (22) and, in the rear segment (12), connects to the connector (34) coming out of said manually actuated pump which draws the washing liquid from the reservoir (20) and channels it into the flexible hose (32).

* * * * *